United States Patent [19]

Douthwaite et al.

[11] 3,946,668

[45] Mar. 30, 1976

[54] SCREEN PRINTING MACHINES

[75] Inventors: Clifford Douthwaite, Epsom; Stuart Pugh, Loughborough; Ivan Semeneko, Salop, all of England

[73] Assignee: USM Corporation, Boston, Mass.

[22] Filed: Aug. 9, 1974

[21] Appl. No.: 496,298

[30] Foreign Application Priority Data

Aug. 15, 1973 United Kingdom ..... 38541/73

[52] U.S. Cl. ..... 101/123; 101/126; 101/127.1; 101/128.1

[51] Int. Cl.[2] ..... B41F 15/36

[58] Field of Search ..... 101/114, 115, 123, 126, 101/127.1, 128.1

[56] References Cited

UNITED STATES PATENTS

| | | | |
|---|---|---|---|
| 2,881,700 | 4/1959 | Podgor | 101/126 |
| 3,650,208 | 3/1972 | Lambert | 101/123 |
| 3,828,671 | 8/1974 | Fuchs | 101/123 |

*Primary Examiner*—Edgar S. Burr
*Assistant Examiner*—R. E. Suter
*Attorney, Agent, or Firm*—Ralph D. Gelling; Vincent A. White; Richard B. Megley

[57] ABSTRACT

In a standard screen printing machine a linkage assembly is provided for connecting the screen support and the printing bed support in such a manner that the screen support is movable into and out of an operative position. The link arrangement is selectively connected to the screen support to provide, in the alternative, movement according to a parallel linkage arrangement or tilting movement about an axis of the linkage assembly.

2 Claims, 8 Drawing Figures

SCREEN PRINTING MACHINES

BACKGROUND OF THE INVENTION.

In conventional screen printing machines currently available, a major problem which arises is in the registration of a workpiece to be printed and a screen by which the printed pattern is to be applied. This is especially the case where more than one colour is to be printed on the same workpiece, so that the registration of successive screens relative to the workpiece has to be achieved. The registration can be broken down into a number of parts, namely locating a workpiece on the printing bed in an accurate location, locating the printing bed relative to the screen support, and locating a screen in accurate location in the screen support. For locating the screen support in accurate location with a printing bed, it is usual to rely on the rigidity of the machine construction. This approach is not, however, satisfactory in that accuracy of registration is nevertheless difficult to achieve, and furthermore the construction is complicated and consequently expensive. Similarly, it is often the case that screens of different sizes are located in the machine without reference to any particular datum line, so that the registration of screens in the screen support is similarly unreliable.

In conventional screen printing machines, furthermore, a so-called "snap" distance is customarily provided, this distance being that between the screen and the surface of the workpiece to be printed, over which distance the screen is distorted by pressure from the squeegee into line contact with the workpiece at the point of pressure application, the screen then "snapping" away from the workpiece after the squeegee has moved therepast. In conventional screen printing machines, the snap adjustment is frequently made without mechanical aids, e.g. by the use of makeready.

With currently available screen printing machines, the movable support may be supported for movement towards and away from the other support in one of two manners, namely by means of a parallel linkage arrangement or for tilting movement. Customarily, some printers prefer a parallel linkage system and others a straightforward tilting system. This is arduous on the machinery manufacturer, who is thus faced with the choice either of offering one only of the systems or alternatively manufacturing two ranges of machines to cater for the printer's choice.

Furthermore where suction is used to hold a workpiece on a printing bed, it is often necessary to use switching means for starting and stopping the vacuum pump, which arrangement is expensive and time-consuming.

Summary of the Invention

Accordingly, it is an object of the present invention to provide an improved screen printing machine which renders more reliable the registration of the screen support and the printing bed support, and therefore of a screen supported by the screen support and a workpiece located on a printing bed supported by the printing bed support.

A further object of the invention is to provide an improved screen printing machine in which the lateral register between the screen support and the printing bed support and also the adjustment of the snap distance between a screen supported by the screen support and a workpiece located on a printing bed supported by the printing bed support are achieved by relatively simple means.

Another object of the invention is to provide an improved screen printing machine in which a screen can be supported by the screen support always with reference to the same datum line.

Still a further object of the invention is to provide an improved screen printing machine in which a workpiece is held by suction on the printing bed, but in which such suction is readily released at the end of a printing operation without the need for any exxpensive switching gear.

A still further object of the invention is to provide an improved screen printing machine which by relatively simple means can be converted from a "parallel linkage" machine to a "tilting head" machine.

These objects of the invention are severally achieved by providing in a screen printing machine means for both registering the screen support and the printing bed support one with the other and also adjusting the snap distance between a screen supported by the screen support and a workpiece located on a printing bed supported by the printing bed support in an operative relationship, said means comprising a plurality of sets of abutment members, each of which sets includes a fixed member mounted on one of said two supports and an adjustable member mounted on the other of said two supports, and at least two of which sets each include cooperating registration faces on said members, which faces are brought into engagement with one another when relative movement of approach is effected between the screen support and the printing bed support. Furthermore, in said machine, the screen support is connected by a link arrangement with the printing bed support and is movable relative thereto into and out of an operative position, the link arrangement being mounted on the printing bed support for pivotal movement about an axis extending laterally of the machine and being selectively connected to the screen support either so as to form part of a parallel linkage arrangement or so as to enable the screen support to tilt about said axis as said support is moved into and out of its operative position. To this end, the link arrangement comprises two sets of links, arranged one at either side of the two supports, a first one of the links of each set being supported on the printing bed support for pivotal movement about said axis and also being pivotally connected to the screen support at a first pivot point, and a second link of each set being pivotally supported on the printing bed support at a second pivot point and being pivotally connected to the screen support at a third pivot point, wherein the relationship between the axis and the second pivot point is substantially the same as the relationship between the first and third pivot points. The pivotal connection at the third pivot point is by means of a pin, which is readily removable, so that with the pin in position a parallel linkage arrangement is provided, and without the pin in position the screen support can tilt about said axis. The screen support comprises a frame, comprising two spaced apart side arms and a front member connecting the side arms, each side arm supporting a side member having a plurality of notches, which side members are arranged for supporting a screen in the frame and such screen being held in position using one notch of each side member selected according to the screen size. The side members are preferably movable along the side arms towards and away from the front member, whereby a screen supported by the side members as aforesaid can be urged against the front member. The printing bed of the screen printing machine is in the form of a vacuum platen comprising a top perforated plate and a bottom plate supporting a vacuum pump, a vacuum chamber being thus formed between the plates to which the pump is directly connected. Formed in the bottom plate is an aperture through which the chamber can be connected to atmosphere, a valve plate being provided which is movable between an aperture-closing position and an out-of-the-way position, the arrangement being such that the valve plate moves to its aperture-closing position as the screen support moves to its operative position. In this way, when the screen support moves to its operative position, so that a screen supported thereby is in an operative relationship with a workpiece located on the printing bed, the valve plate closes and seals the aperture formed in the underside of the vacuum platen so that suction is applied to the workpiece located on the printing bed.

DESCRIPTION OF THE DRAWINGS

There now follows a detailed description, to be read with reference to the accompanying drawings, of one screen printing machine in accordance with the invention, which screen printing machine has been selected for description in order to illustrate the invention. It will of course be appreciated that this illustrative machine has been selected for description merely by way of exemplification of the invention and not by way of limitation thereof. In the description reference will be made to the accompanying drawings wherein.

Figure 1:
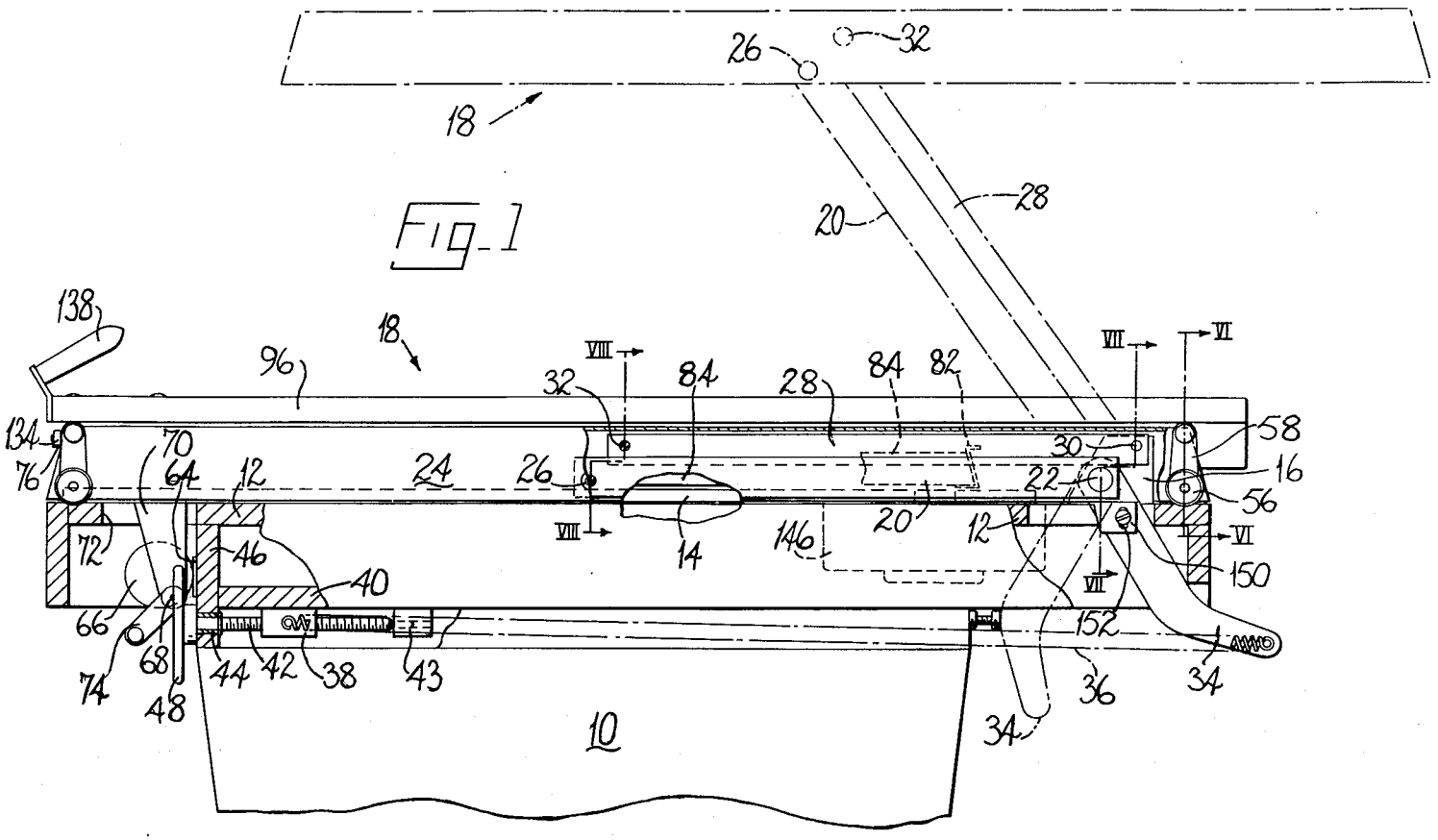
FIG. 1 is a side view, with parts shown in section, of the illustrative machine.
Figure 2:
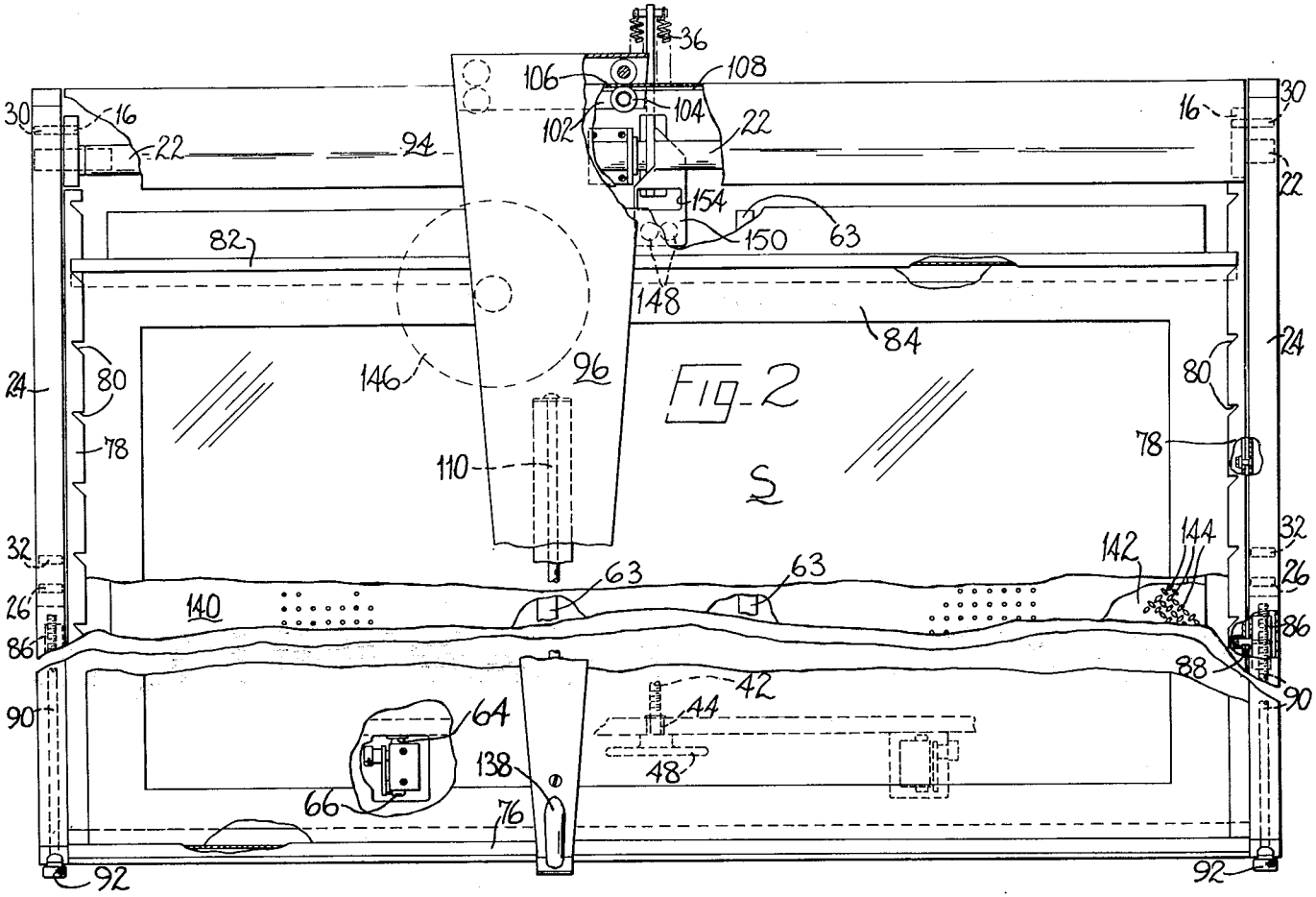
FIG. 2 is a plan view, with parts broken away, of the illustrative machine.

The illustrative machine, which is a hand-operated screen printing machine, comprises a main frame 10 (FIG. 1) an upper plate 12 of which provides a support for a printing bed, in the form of a vacuum platen generally designated 14 (see FIG. 2). Towards the rear of the upper plate 12 are arranged, one at either side thereof, two brackets 16 on which is supported, for movement towards and away from the upper plate 12, a screen support generally designated 18.

Figure 8:
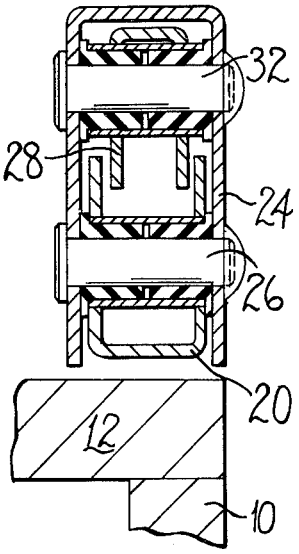
FIG. 8 is a section view along the line VIII—VIII of FIG. 1, showing first and third pivot points of said parallel linkage arrangement.
Figure 7:
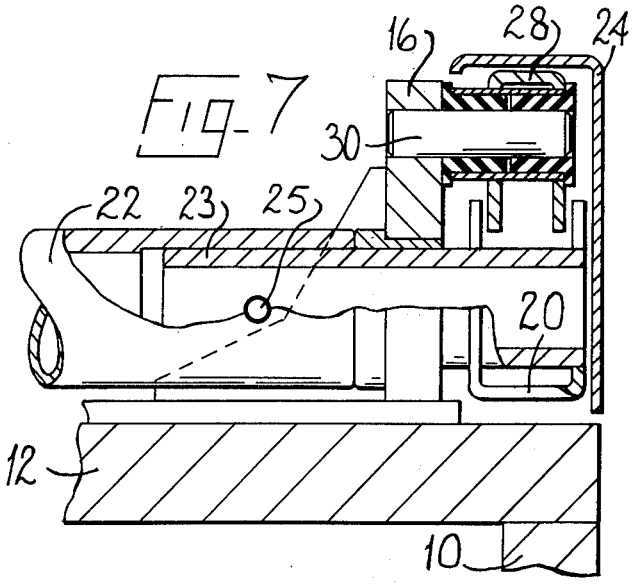
FIG. 7 is a section view taken along the line VII—VII of FIG. 1, showing an axis and a second pivot point of a parallel linkage arrangement by which the screen support is supported for movement towards and away from the printing bed support.

The screen support 18 is carried by a parallel linkage arrangement, which comprises two sets of links, one set arranged at either side of the top plate 12. Each set of links comprises a first link 20 (FIGS. 7 and 8) which is secured on a stub shaft 23, the two stub shafts (one only shown in FIG. 7) being carried by the brackets 16. Each stub shaft 23 is secured, by a connecting pin 25, to a cross shaft 22 which extends across the whole of the width of the illustrative machine. Thus the links 20 are secured to the cross shaft and pivot together therewith about its axis. The end of each link 20 remote from the cross shaft 22 is pivotally connected at a first pivot point to a side arm 24, forming part of the screen support 18, by means of a pivot pin 26 (FIG. 8). Similarly, each set of links of the parallel linkage arrangement comprises a second link 28 which is mounted on a stub shaft 30 (FIG. 7), the stub shafts forming second pivot points and each being received in one of the brackets 16. Each second link 28 is pivotally connected at its other end by means of a pivot pin 32 (FIG. 8) (constituting a third pivot point) to the side arm 24. The relationship between the cross shaft 22 and the stub shaft 30 of each set of links is the same, or substantially the same, as the relationship between the pivot pins 26 and 32. The first link 20 of each set is of U-shaped cross-section, while the second link 28 of each set has a cross-sectional shape of inverted U, the arrangement being such that the arms of the inverted U are accommodated within the arms of the U of the first link 20.

If it is desired to convert the illustrative machine to a tilting screen machine, as opposed to the parallel linkage machine, the pins 30 may be removed and, if desired, the links 28 may be clipped to the links 20 in such a manner as to allow relative sliding movement therebetween. The weight distribution on the screen support 18 is such that, in the absence of the pins 30, raising a front edge of the screen support 18 is effective to cause the screen support to tilt to an out-of-the-way position.

In another screen printing machine in accordance with the invention, and otherwise similar to the illustrative machine, the links 28 may be secured to the side arms by a pin-and-slot connection (not shown), the arrangement being such that the pins are locked in a position corresponding to the position of the pins 32 in the illustrative machine, when it is required that a parallel linkage machine is to be used, but being free to travel along the slots, when a tilting screen machine is desired.

Projecting downwardly from the cross shaft 22 of the illustrative machine is an arm 34 (FIG. 1), arranged centrally of the machine (see FIG. 2). Acting on an end of said arm 34 remote from the cross shaft 22 are two elongated springs 36 secured at a forward end thereof to a block 38 mounted for sliding movement on a support plate 40 forming part of the main frame 10. The block 38 receives a threaded rod 42 which is held captive in a bush 44 secured in a plate 46 extending across the front of, and forming part of, the main frame 10. The rod 42 carries, at its end extending outside the main frame, a hand wheel 48, rotation of which is thus effective to cause the block 38 to move fore-and-aft of the machine, thereby varying the tension of the springs 36. At end, remote from the hand wheel, of the rod 42 is of reduced diameter and is received in a block 43, thus to stabilise the rod in the machine frame. The influence of the springs 36 is balanced with the weight of the screen support 18 and associated parts so that the springs are biased constantly to urge the screen support 18 to an out-of-the-way position, but the centre of gravity of the screen support, and thus the effective weight thereof are so arranged relative to the cross shaft 22 and stub shafts 30 that the weight of the screen support and associated parts overcomes the influence of the springs when the screen support is lowered into an operating position (in which a screen S supported thereby and a workpiece W supported on the vacuum plate 14 are in an operative relationship). The springs thus serve to hold the screen support down when in its operative position, while movement of the screen support to an out-of-the-way position is assisted by means of the springs, to an extent that the springs will carry the screen support to such position, once it has been manually moved from its operating position.

Figure 6:
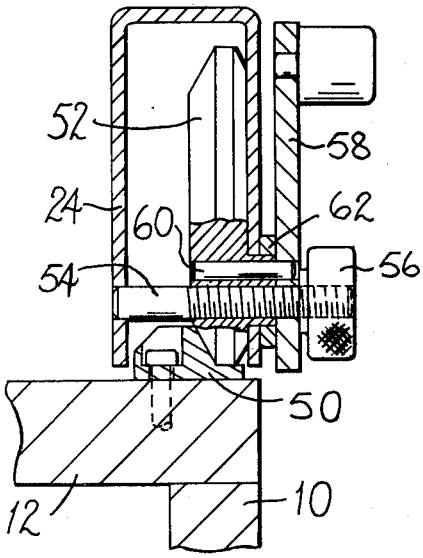
FIG. 6 is a section view taken along the line VI—VI of FIG. 1, showing one set of abutment members by which the snap distance and lateral registration of the screen support relative to the printing bed support is achieved.

The mounting for the screen support 18 described above provides the fore-and-aft register between a vacuum platen 14 and a screen S supported by the screen support 18. For achieving lateral registration between these two, on the other hand, the illustrative machine comprises four sets of abutment members, arranged one at each corner of the top plate 12 providing the printing bed support. As best seen in FIG. 6, each set of abutment members comprises a first abutment member 50 fixedly supported on the upper plate 12 and a second abutment member 52 in the form of a disc having an abutment surface formed complementary to a co-operating abutment surface provided by the first member 50. The disc is arranged inside the side arm 24 and is eccentrically mounted on a threaded portion of a rod 54 supported in the side arm, a clamp nut 56 being threadedly secured on an outer end of said rod. Located between the side arm and the clamp nut 56 is a handle 58 which is connected to the disc 52 by means of a connecting pin 60, so that the disc can be rotated about the axis of the rod 54 by means of the handle 58. Supported on an integral bush of the disc, and acting between the handle and the side arm, is a spring washer 62, the arrangement being such that the clamp nut 56 is screwed up on the threaded rod sufficiently to ensure that the disc will be held under the influence of the spring washer in a position, as determined using the handle 58. The throw of the eccentrically mounted disc is such that the snap distance can be adjusted over a range of some 2 inches to accommodate varying workpiece thicknesses. It will of course be appreciated that the operator has to set each of the four sets of abutment members individually, in using the illustrative machine.

The vacuum platen 14 providing the printing bed of the illustrative machine is supported on the upper plate 12, wear strips 63 (FIG. 2), e.g. of nylon, being provided on said plate to minimise wear. The vacuum plate 14 is located on the upper plate 12 by a three-point location system which again comprises three sets of abutment members, constituting printing bed location means (FIGS. 1 and 2). The sets of abutment members are secured on the under-side of the vacuum platen, two at opposite sides of a centre line of said platen (see FIG. 2) and a third along a left-hand edge thereof. Alternatively, the third set may be located just to the right of the hand wheel 48, at the front of the machine. Each set of abutment members includes a fixed abutment surface 64 (one only shown in FIGS. 1 and 2), provided by runner strips secured, in the case of said two sets, on the plate 46, and, in the case of said other set, on a plate (not shown) extending fore-and-aft of the machine and forming part of the main frame. The other abutment member of each set is provided by a disc 66 eccentrically mounted on a pin 68 carried at a lower end of a bracket 70 depending from the underside of the vacuum platen, apertures 72 being provided in the upper plate 12 to accommodate said brackets. Each disc 66, which is generally similar in construction and arrangement to the discs 62, can be caused to rotate about the pin 68 by means of a handle 74. The vacuum platen 14 is resiliently urged into engagement with the three discs 66 by a plurality of springs (not shown) which also serve to hold the vacuum platen down on the upper plate 12. It will be appreciated that, by rotating the discs 66, at the discretion of the operator, the vacuum platen can be located in register with a screen supported by the screen support 18.

Figure 3:
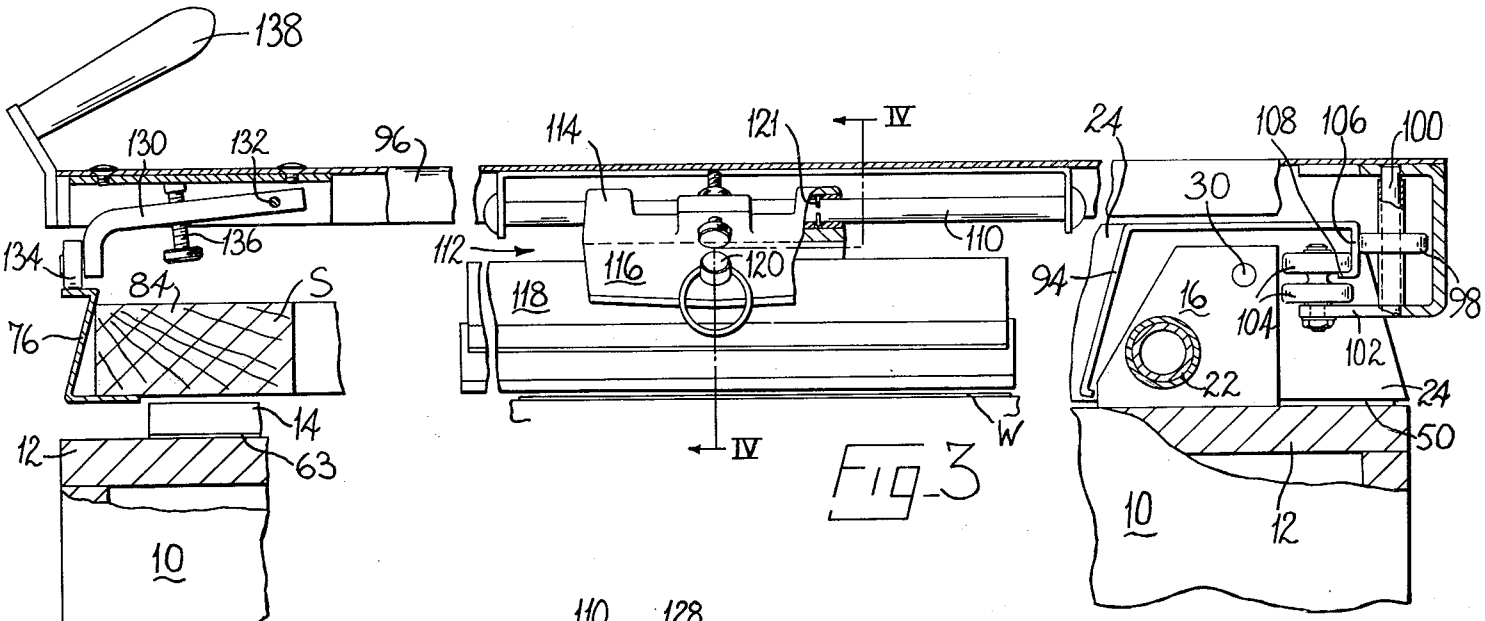
FIG. 3 is a side view, also with parts broken away and partly in section, showing a support arm for a squeegee assembly of the illustrative machine.
Figure 5:
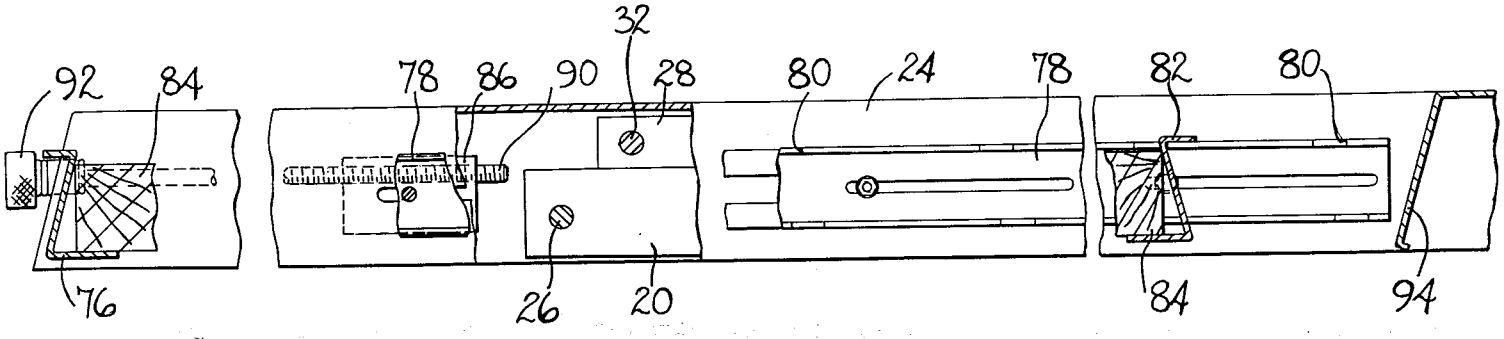
FIG. 5 is a fragmentary view of a side arm of the illustrative machine, showing parts of a screen support.

The screen support 18 of the illustrative machine comprises, in addition to the side arms 24, a front cross member 76 which has a Z-shaped cross-section when viewed from the right-hand side (see FIGS. 3 and 5). In addition, said support comprises two side members 78, one secured for sliding movement along each of the side arms 24. Each side member 78 is provided with a plurality of notches 80 by which a rear member 82 (FIG. 5) of the screen support can be held, the arrangement being such that the rear member 82 is held by one notch in each side member 78, selected according to the size of screen S to be used. The rear member 82 also has a Z-shaped cross-section viewed from the left-hand side of the machine. Thus, it will be appreciated that the "base" of the Z of both the front and rear members 76, 82 face inwardly towards one another. These "bases" provide support for a frame 84, e.g. of wood, in which a screen is held. The screen itself may be of any conventional construction and may be made of any conventional screen material, e.g. Terylene.

For moving the side members fore-and-aft of the illustrative machine, each side member is secured to a block 86 (FIG. 5) which is secured in turn, by a pin-and-slot connection generally designated 88, to its associated side arm 24. Threadedly received in the block 86 is a threaded rod 90 which extends forwardly of the side arm and is provided with a knurled head 92 projecting forwardly of its associated side arm 24. Rotation of the threaded rods 90 is thus effective to move each side member relative to its supporting side arm 24. In this way, by causing the side members 78 to advance towards the front member 76, a screen S supported thereby is urged forwardly into abutting engagement with the Z of the front member and becomes firmly engaged between the front and rear members 76, 82, the oblique surfaces of which act to urge the screen downwardly into engagement with the bases thereof. In this way, the screen can be held securely in the screen support 18.

Mounted above the screen support, and supported on a support structure 94 extending between the two side arms 24 at the rear of the machine, is a support arm 96 for a squeegee assembly (FIGS. 2 and 3). More specifically, for supporting said arm, a roller arrangement comprising a first roller 98 supported by a stub shaft 100 extending between said arm and an inturned flange 102 thereof, and a recessed roller 104 supported near an inward edge of said flange. The support structure 94 includes an integral vertical rear plate 106 with a rearward face of which the roller 98 engages and with a forward face of which an upper part of the roller 104 engages, the arrangement being such that said upper part of the roller 104 is in a slightly lower plane than the roller 98 (as seen in FIG. 3). The lower edge of the rear plate 106 is inturned to provide a narrow flange 108 which is accommodated in the recess of the roller 104, thus to limit the downward movement of the arm 96 relative to the support structure 94, and thus relative to the screen support 18. By supporting the support arm 96 in the manner described above, it will be appreciated that the arm can be tilted to a limited extent to raise the squeegee support arm away from the screen support, e.g. when it is desired to change a screen S or a squeegee assembly.

Figure 4:
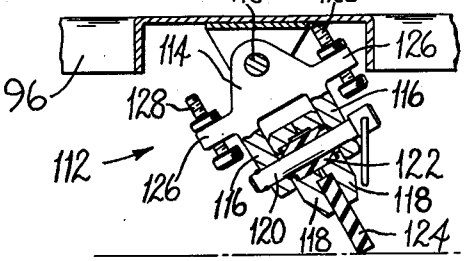
FIG. 4 is a sectional view of the support arm taken along the line IV—IV of FIG. 3.

Supported on an underside of the support arm 96 is a carrier rod 110 extended fore-and-aft of the illustrative machine, on which rod a squeegee assembly support generally designated 112 is supported for pivotal movement about the axis of the rod. The support 112 comprises a block 114 having two depending limbs 116 (FIG. 4) provided with aligned bores. The squeegee assembly comprises two clamp members 118 which can be received between said limbs. Each clamp member is provided with an aperture, which can be aligned with the aligned bores of the limbs 116, the apertures having counter-bores so that a bush 122 can be accommodated therein. Accommodated in said bush and extending through the bores in said limbs is a securing pin 120 which facilitates limited pivotal movement of the clamp members about its axis. Along the lower edges of opposed faces of the clamp members 118 are provided cut-away portions which together form a recess in which an upper edge of a squeegee blade 124 can be received, the arrangement being such that the squeegee blade is clamped in position in said recess between the clamp members which are secured together by means of screws (not shown). The squeegee blade may be of any conventional construction, and may be made of any conventional material. It will thus be appreciated that a squeegee assembly can readily be replaced merely by removal of the pin 120.

The block 114 of the squeegee assembly support is also provided with two lateral limbs 126 each of which carries an adjustable stop screw 128, the arrangement being such that said screws 128 limit the amount of pivotal movement in both directions of the squeegee assembly support about the axis of the rod 110. In addition, the block 114 carries two split rings 121 (FIG. 3) which provide a frictional engagement with the rod 110 so that the squeegee assembly support can be slid along the rod 110, but be held in position by said split rings, thus to accommodate squeegee assemblies of different length.

In using the illustrative machine, the operator may prefer to apply pressure to the squeegee at his own discretion according to the "feel" of the work. Alternatively, however, the forward end of the arm 96 may be lowered to bring the squeegee blade 124 into contact with the screen S to a limit determined in the following manner. Secured to a forward end portion of the arm 96 is a cranked arm 130 (FIG. 3) pivotally mounted on a pin 132. At its forward, depending, end, said arm carries a roller 134 arranged to run on a top face of the front member 76. An adjusting screw 136 is secured in the cranked arm and abuts against a stop face provided on the under-side of the arm 96 thus to vary the position of the roller 134 relative to the arm, and thus the position of the arm, and of the squeegee blade 124, relative to the screen S supported by the screen support. The arm can loosely pivot about the pin 132, e.g. when the arm 96 is tilted to an out-of-the-way position, to an extent determined by engagement of an edge of the arm with an under-surface of the arm 96.

For moving the support arm 96, and thus the squeegee blade 124, laterally of the illustrative machine, a handle 138 is provided, secured at a front edge of the arm 96.

The vacuum platen 14 of the illustrative machine comprises a perforated top plate 140 (FIG. 2) and a bottom plate 142, the plates being sealingly secured together, but spaced apart from one another, in order to provide therebetween a vacuum chamber. The bottom plate, which is made of aluminium, has upstanding integral projections 144 by which the two plates are spaced apart. (The bottom plate may be conventional so-called "tread plate"). Secured on an under-side of the bottom plate 142 is a vacuum pump 146 (see also FIG. 1), which is thus directly connected to the vacuum chamber. An aperture is provided in the upper plate 12 for accommodating the vacuum pump. Also provided on the under-side of the bottom plate 142 are two side-by-side apertures 148 (FIG. 2) by which the vacuum chamber can be connected to atmosphere. For covering and sealing said apertures, when it is desired that a workpiece should be held on the workpiece supporting surface provided by the top plate 140, there is provided a valve plate 150 which extends between the upper plate 12 of the main frame and the bottom plate 142 of the vacuum platen (the wear strips 63 providing adequate clearance therefor) and which is connected to the projecting arm 34 by means of a pin-and-slot connection 152, the arrangement being such that pivotal movement of the arm 34 as described above will be effective to move the valve plate forwardly and rearwardly of the illustrative machine to seal or uncover the apertures 148. For uncovering the apertures, the valve plate 150 is provided with an aperture 154, the arrangement being such that as the arm 34 is caused to pivot rearwardly, and thus the screen support 18 is lowered into operating position, the valve plate 150 is withdrawn and moves to an aperture-closing position in which the aperture 154 is no longer in alignment with the apertures 148 which thereby become covered (as shown in FIG. 2). In this way, the vacuum pump can be run continuously in the operation of the illustrative machine, but the vacuum is only applied through the perforated top plate 140 of the vacuum platen when the screen support is lowered into its operative position.

In using the illustrative machine, conveniently the operator first selects the screen to be used and secures it in the screen support in the manner described above. With the vacuum pump switched on, he can then register the vacuum platen, providing the printing bed, by means of the sets of abutment members 64, 66, in a conventional manner, a conventional three-point location being provided on the printing bed for locating a workpiece to be printed relative to the pattern of the screen S. Also the snap distance is adjusted according to the thickness of the workpiece. The sets of abutment members 50, 52 ensure that the lateral register is maintained and the parallel linkage arrangement ensures that the fore-and-aft registration is maintained. At the same time, the operator selects an ink to be applied and flood-coats the screen in a conventional manner. The illustrative machine is ready for use.

The operator then locates a workpiece on the top plate 140 of the vacuum platen and manually moves the screen support, and the screen S and squeegee blade 124 therewith, into operative position, the vacuum chamber being sealed from the atmosphere by such movement and the workpiece then being held by suction on the vacuum platen. The operator then manually causes the squeegee blade to be traversed across the screen to carry out a printing operation in the conventional manner, the squeegee being tilted at an angle determined by the "trailing" adjustable screw 128. When the operation is completed, the operator returns the squeegee, having pivoted it about the axis of the rod 110 to a limit determined by the other stop screw 128, and the squeegee blade then acts as a doctor blade to carry out a flood-coating operation in the conventional manner. The screen support is then caused to be moved to an out-of-the-way position and the finished workpiece is removed and a next workpiece to be operated upon placed on the vacuum platen.

I claim:

1. In a screen printing machine having a printing bed, a screen, and a squeeggee for applying ink to a workpiece through the screen, apparatus for moveably supporting the screen on the printing bed comprising:

A. a screen support for mounting the screen in operative relation to the printing bed;

B. a printing bed support for mounting the printing bed in opertive relation to the screen;

C. a first pair of parallel linking elements, one end of each element being pivotally connected to the screen support at opposite sides thereof and the other end of each element being pivotally connected to the printing bed support at opposite sides thereof;

D. a second pair of parallel linking elements extending parallel to the first pair of parallel linking elements and being pivotally connected to the screen support and the printing bed support at pivot points spaced from the points of connection of said first pair of linking elements; and E. coupling means for releasably connecting one end of the second pair of parallel linking elements to the corresponding pivot point to allow alternative unrestricted pivotal motion of the screen support about the pivot axes of the first pair of linking elements.

2. In a screen printing machine having a printing bed, a screen, and a squeegee for applying ink to a workpiece through the screen, apparatus for moveably supporting the screen on the printing bed as described in claim 1 wherein the first and second pairs of parallel linkage elements comprise first and second u-shaped channel members each having a web portion and a set of arms extending therefrom, the arms of each number being in opposing relation and one of said sets of arms extending within the other.

* * * * *